US009414649B1

(12) United States Patent
Siklosi

(10) Patent No.: US 9,414,649 B1
(45) Date of Patent: Aug. 16, 2016

(54) PROGRESSIVE COMPRESSIVE ZIPPER

(71) Applicant: Century, LLC, Oklahoma City, OK (US)

(72) Inventor: Tibor Siklosi, Norman, OK (US)

(73) Assignee: Century, LLC, Oklahoma City, OK (US)

( * ) Notice: Subject to any disclaimer, the term of this patent is extended or adjusted under 35 U.S.C. 154(b) by 290 days.

(21) Appl. No.: 13/915,116

(22) Filed: Jun. 11, 2013

(51) Int. Cl.
*A44B 1/04* (2006.01)
*A44B 19/40* (2006.01)
*A44B 19/26* (2006.01)

(52) U.S. Cl.
CPC ..... *A44B 19/40* (2013.01); *A44B 19/26* (2013.01)

(58) Field of Classification Search
CPC ..... Y10T 24/2595; A45C 13/103; A45C 7/0068; A45C 7/0031; A45C 7/0013
See application file for complete search history.

(56) References Cited

U.S. PATENT DOCUMENTS 3,879,865 A * 4/1975 Kimball ..... A43B 3/16 36/7.3
4,492,006 A * 1/1985 Ishii ..... 24/382
5,307,908 A * 5/1994 Shyr et al. ..... 190/18 A
5,810,166 A * 9/1998 Weinreb ..... 206/316.2
6,654,968 B2 * 12/2003 Braun et al. ..... 2/269
2005/0022307 A1 * 2/2005 McClintock ..... A47C 21/022 5/706
2006/0196743 A1 * 9/2006 Lin ..... 190/18 A
2010/0048363 A1 * 2/2010 Gilberti et al. ..... 482/105
2012/0149536 A1 * 6/2012 Trimble et al. ..... 482/93

* cited by examiner

*Primary Examiner* — Robert J Sandy
*Assistant Examiner* — Matthew Sullivan
(74) *Attorney, Agent, or Firm* — Head, Johnson & Kachigian, P.C.

(57) ABSTRACT

A progressive compressive zipper for attaching an at least partially compressible first component, such as a foam-core punching or training bag, to a second component, such as a weighted base. The first component has a first zipper half that encircles the first component near, but not adjacent to, the surface along which it connects to the second component and then angles downward toward the connecting surface, forming a ramp. The second component has a corresponding second zipper half attached to its connecting surface. A user may place the first component against the second component and zip the first zipper half and the second zipper half together, starting with the ramp. As the zipper is engaged, the first component is compressed against the second component due to the angle of the ramp.

8 Claims, 4 Drawing Sheets

PROGRESSIVE COMPRESSIVE ZIPPER

CROSS REFERENCE

Not Applicable.

BACKGROUND OF THE INVENTION

1. Field of the Invention

This invention relates generally to a zipper, and more particularly, but not by way of limitation, to a progressive compressive zipper for use in joining two halves of a training bag.

2. Description of the Related Art

Free standing punching or training bags are typically constructed with blow molded or injection molded plastic bases, which are weighted with up to 300 lbs. of weighted material such as sand, water, or other material. The base is fitted with a separate vinyl punching bag, which is mounted after loading the base with the weighted material. The problem is that it is difficult to assemble and/or connect a heavy weighted plastic base with a vinyl-skinned soft punching bag top such that the device remains easy to assemble while providing the structure and durable functional properties required of a punching bag.

It is desirable to provide a punching bag with the base and top made of like material, such as vinyl. Such a punching bag is similarly difficult to assemble and/or connect because the foam-filled top must be forcefully compressed and joined to the base to produce a firm connection such that the vinyl top skin is stretched firmly over the foam with no wrinkles and firmly to the base so that the rebounding properties of the foam are consistent when struck by the user.

Zippers are commonly used to connect two items or two parts of the same item together. No other zipper closure device, however, utilizes a zipper construction to connect two independent components while using leverage by the closure to compress the two parts together. While expandable suitcases utilize zippers to expand/contract the relative material capacity of luggage storage space, luggage zippers of this design are permanently attached to one piece of material. Such luggage zippers do not connect two separate pieces, they remain permanently connected, and they do not enable connecting two dissimilar components. Furthermore, such luggage zippers do not compress one component to another, but merely alter the capacity of the luggage.

Based on the foregoing, it is desirable to provide a zipper for connecting the top and base of a training bag.

It is further desirable for the zipper to be constructed to act as a ramp to gradually compress the top to the base.

It is further desirable for the zipper ramp incline to maintain an optimum balance between the coefficient of friction between joining zippers and the forces required to fully compress the foam firmly to the base.

It is further desirable for the ramp-up zipping method to allow one person to easily and effectively attach the top to the weighted base.

SUMMARY OF THE INVENTION

In general, in a first aspect, the invention relates to a zipper device comprising a first component, a second component, a first zipper half, and a second zipper half. The first component may be at least partially compressible and has a connecting surface and at least one sidewall extending from the connecting surface. The second component may be separate from the first component, and the second component may have a connecting surface such that the connecting surface of the first component may be placed adjacent to the connecting surface of the second component for connecting. The first zipper half may be attached to the first component such that the first zipper half is at least partially attached to the at least one sidewall of the first component. The first zipper half may comprise an encircling portion that encircles the first component near but not adjacent to the connecting surface and a ramp portion that extends from the encircling portion toward the connecting surface at less than a 90° angle, where the ramp portion is contiguous to the encircling portion. The second zipper half may be attached to the second component such that the second zipper half is at least partially attached to the connecting surface of the second component. The second zipper half may comprise an attached portion corresponding to the encircling portion of the first zipper half and a tail portion corresponding to the ramp portion of the first zipper half, where the tail portion is contiguous to the attached portion. The first zipper half and the second zipper half may be zipped together to connect the first component to the second component and to at least partially compress the first component against the second component.

The first component may be a training or punching bag comprising a vinyl skin and a foam core and the second component may be a base comprising a vinyl skin and weighted material. The first zipper half and the second zipper half may each comprise a plurality of teeth such that the teeth of the first zipper half may engage the teeth of the second zipper half. The first zipper half may further comprise a zipper pull capable of receiving the second zipper half. The tail portion of the second zipper half may be located behind the attached portion of the second zipper half such that the tail portion of the second zipper half and the ramp portion of the first zipper half are located behind the attached portion of the second zipper half and the encircling portion of the first zipper half when the first zipper half and the second zipper half are fully zipped. The first component may further comprise a flap adjacent the encircling portion of the first zipper half such that the flap may extend over and conceal the first zipper half and the second zipper half when fully zipped.

The zipper device may be used in a method comprising: placing the connecting surface of the first component adjacent the connecting surface of the second component; and compressing the first component at least partially by zipping the ramp portion of the first zipper half and the tail portion of the second zipper half together, then progressing to zipping the encircling portion of the first zipper half and the attached portion of the second zipper half together to complete compressing the first component at least partially and joining the first component to the second component. The method may further comprise folding a flap attached to the first component adjacent the encircling portion of the first zipper half over the first zipper half and the second zipper half.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
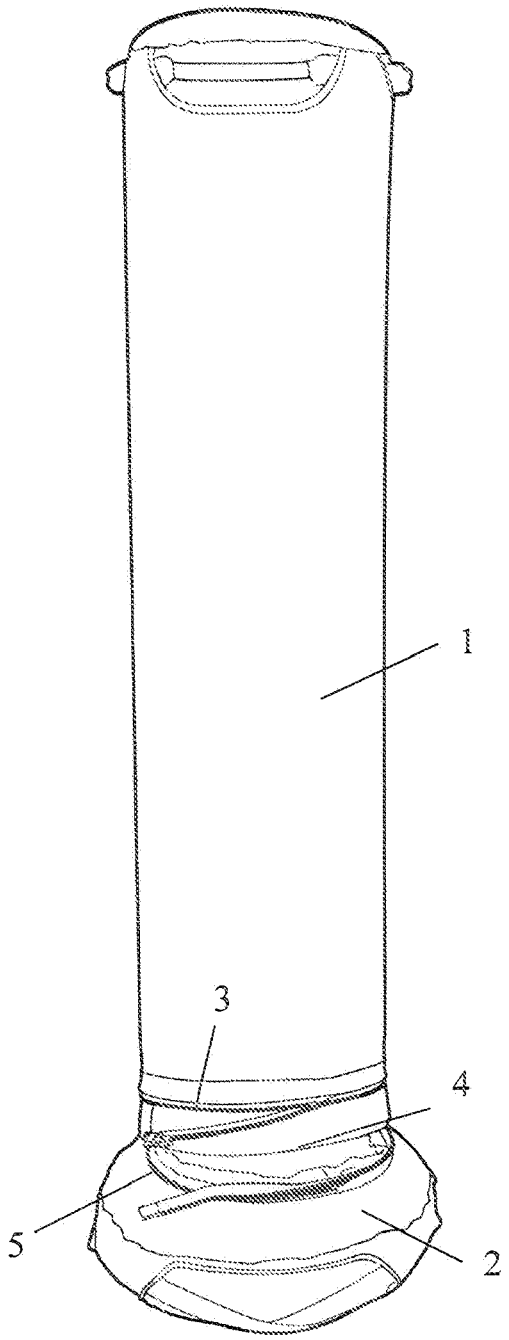
FIG. 1 is perspective view of a training bag with the top portion of the bag connected to its base via a progressive compressive zipper in an unzipped position.

In general, in a first aspect, the invention relates to a zipper joining two separate components, where engaging the zipper provides compression to at least one of the components. As seen in FIG. 1, the progressive compressive zipper is particularly suited to use with a free standing punching or training bag, although it is also appropriate for use with other devices. The zipper may join a first component, here a top 1, to a second component, here a base 2. The first component may be at least partially compressible. The unique zipper design may allow both the top 1 and the base 2 of the training bag to be constructed at least partially of like material, such as vinyl. The top 1 may be generally cylindrical and may be vinyl covered with a foam core, and the base 2 may likewise be vinyl covered and contain weighted material. The top 1 and base 2, when joined together, may be capable of standing upright due to the weight in the base 2 and may be suitable for use as a training or punching bag. The foam-filled top 1 may be forcefully compressed and joined to the base 2 to produce a firm connection such that the vinyl top skin is stretched firmly over the foam with no wrinkles and firmly to the base 2 so that the rebounding properties of the foam are consistent when struck by the user.

Figure 2:
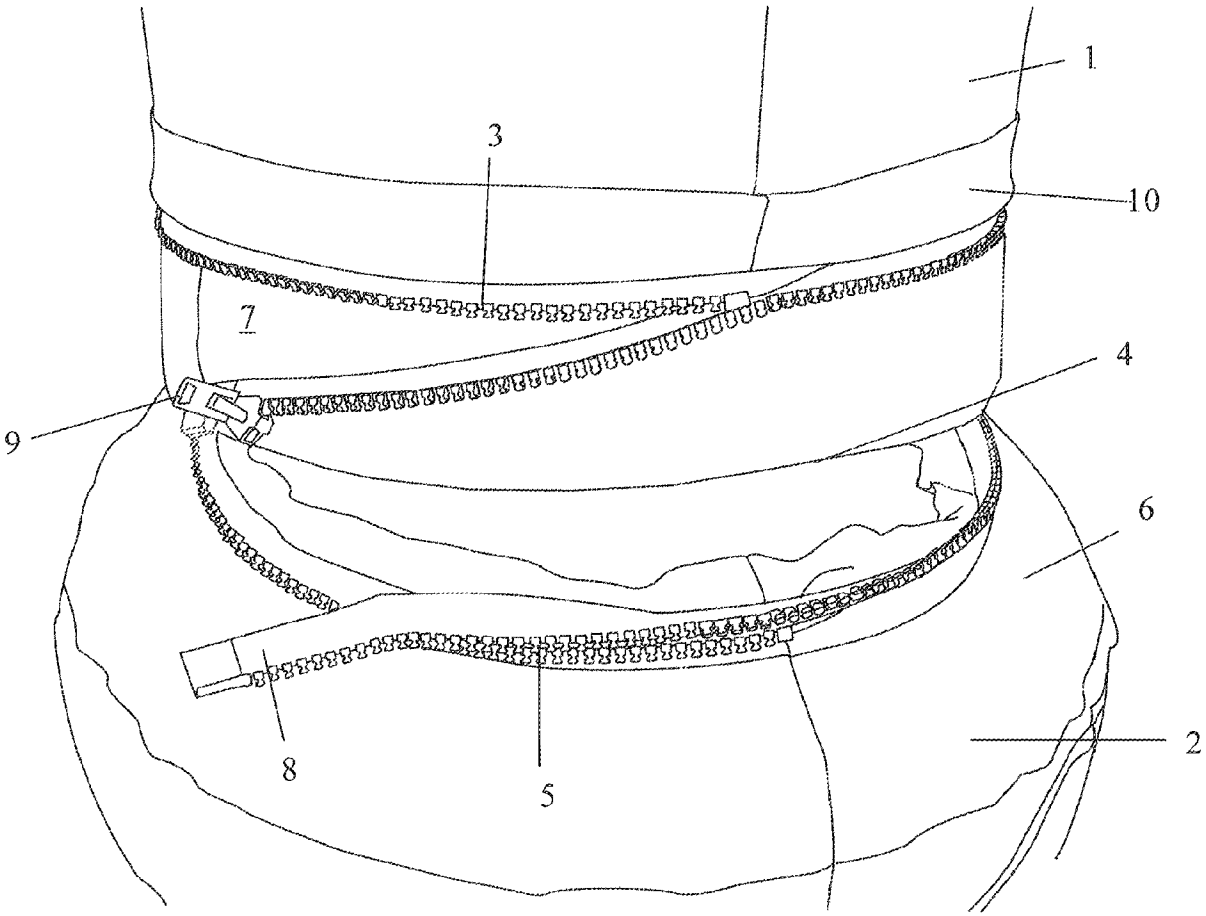
FIG. 2 is a close-up perspective view of the progressive compressive zipper in an unzipped position.

As seen in the close-up of FIG. 2, the top 1, or other first component, may have a first zipper half 3 located near its bottom edge/connecting surface 4, or whichever edge along which the first component joins the second component. The base 2, or other second component, may have a second zipper half 5 located on its top/connecting surface 6, or whichever surface along which the second component joins the first component. The second zipper half 5 may be located such that it may be joined to the first zipper half 3 when the top 1, or first component, is in place on the base 2, or second component. The first zipper half 3 and the second zipper half 5 may each be formed in a way that they may be joined together by being zipped, as a standard zipper, with mating teeth.

The first zipper half 3 may encircle the top 1 a short distance from the bottom edge 4. Where the first zipper half 3 meets its end, it may then angle downward toward the bottom edge 4. This angled portion of the first zipper half 3 effectively forms a ramp 7. The second zipper half 5 may form a circle corresponding to the circle formed by the portion of the first zipper half 3 encircling the top 1, and may have a tail 8. The tail 8 may be at least partially unattached to the base 2 at its end. This makes it easier for the user to attach the end of the tail 8 to the end of the ramp 7. Either the end of the tail 8 or the end of the ramp 7 may have a pull 9 attached thereto. For example, as seen in FIG. 2, the pull 9 may be attached to the end of the ramp 7. This allows the loose tail 8 of the second zipper half 5 to be inserted into the pull 9 to start the zipper.

Figure 3:
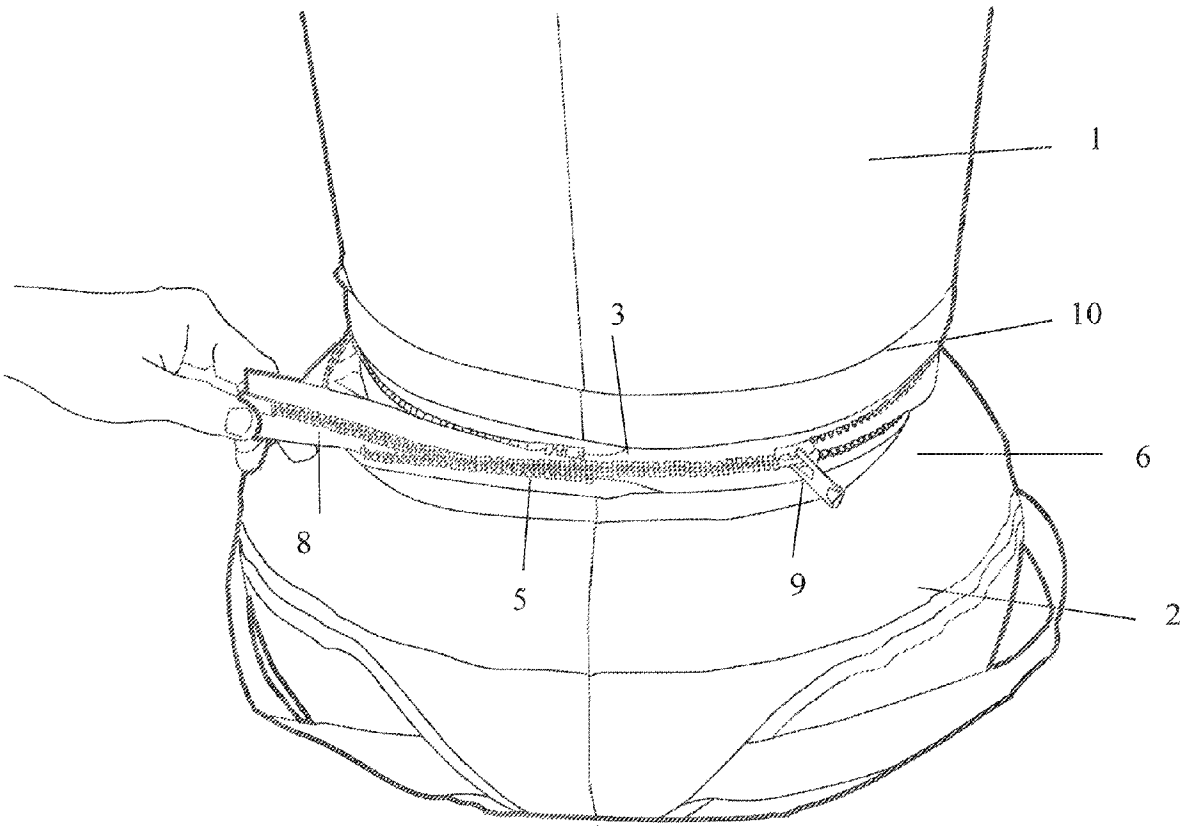
FIG. 3 is a close-up perspective view of the progressive compressive zipper being zipped.
Figure 4:
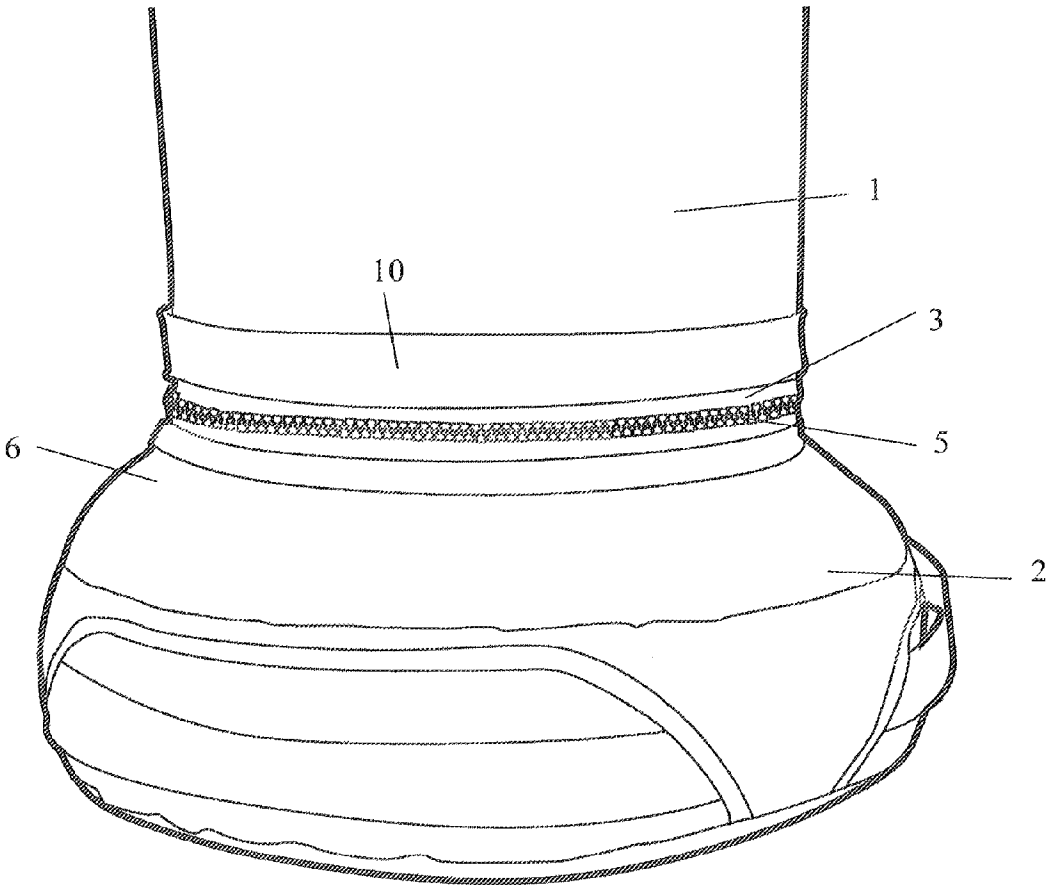
FIG. 4 is a close-up perspective view of the progressive compressive zipper in a fully zipped position.

In use, a user may place the top 1 on the base 2 such that the first zipper half 3 lines up with the second zipper half 5, with the ends of the ramp 7 and tail 8 located adjacent each other, as seen in FIG. 2. The user may insert the tail 8 into the pull 9 and start zipping the zipper. As the angled portion of the first zipper half 3 is engaged by the second zipper half 5, the bottom of the top 1 is compressed due to the angle of the ramp 7. FIG. 3 shows the zipper in the process of being zipped. As can be seen, the tail 8 may be located behind the remainder of the second zipper half 5, between the second zipper half 5 and the top 6 of the base 2, such that it may be tucked behind the completed zipper when fully zipped. The user then continues progressing the pull 9 along the first zipper half 3 and second zipper half 5, fully zipping the zipper along the full circumference of the top 1. The fully zipped assembly may be seen in FIG. 4. It should be noted that the bottom of the top 1 located below the first zipper half 3 is now hilly compressed against the top 6 of the base 2 due to the joining of the first zipper half 3 to the second zipper half 5. The top 1 may have a flap 10 adjacent the portion of the first zipper half 3 capable of being folded downward over the fully zipped zipper. The flap 10 is shown in an upwardly-extending position in the figures to allow the zipper to be seen, but may be folded down during use to hide and protect the zipper.

The ramp construction of the zipper gradually compresses the top and base together as it is zipped. This ramp construction may be designed such that the zipper ramp incline maintains an optimum balance between the coefficient of friction between joining zippers, and the forces required to fully compress the foam firmly to the base. The zipper invention may not only enable the foam top 1 to be firmly connected to a base 2, but the ramp up zipping method may additionally allow one person to easily and effectively attach the weighted base 2 to the top 1.

This invention is unique for several reasons. First, the zipper connects two dissimilar components. Second, the zipper construction enables an easy starting attachment method by use of the extended tail 8 in combination with the ramp 7. Third, the easy-start tail 8 and ramp 7 enables a single person to assemble the two main bodies of the free standing bag. Fourth, the ramp 7 serves to effectively reduce friction while using the lateral zipping action to progressively compress foam material along the circumference of the top 1. Finally, the fully compressed foam top 1 to base 2 assembled by means of the zipper provides the consistent rebounding properties desirable in a punching bag.

Whereas, the devices and methods have been described in relation to the drawings and claims, it should be understood that other and further modifications, apart from those shown or suggested herein, may be made within the spirit and scope of this invention.

What is claimed is:

1. A zipper device comprising:

a first component, where the first component is a training or punching bag comprising a vinyl skin and a foam core, is at least partially compressible, and has a connecting surface and at least one sidewall extending from the connecting surface;

a second component separate from the first component such that the first component is completely unconnected from the second component prior to being zipped together, where the second component is a base comprising a vinyl skin and weighted material and has a connecting surface such that the connecting surface of the first component may be placed adjacent to the connecting surface of the second component for connecting;

a first zipper half attached to the first component such that the first zipper half is at least partially attached to the at least one sidewall of the first component and where the first zipper half comprises:

an encircling portion that encircles the first component near but not adjacent to the connecting surface; and a ramp portion that extends from the encircling portion toward the connecting surface at less than a 90° angle, where the ramp portion is contiguous to the encircling portion; and a second zipper half attached to the second component such that the second zipper half is at least partially attached to the connecting surface of the second component, where the second zipper half comprises:

an attached portion corresponding to the encircling portion of the first zipper half; and a tail portion corresponding to the ramp portion of the first zipper half, where the tail portion is contiguous to the attached portion;

such that the first zipper half and the second zipper half may be zipped together to connect the first component to the second component and to at least partially compress the foam core of the first component against the second component.

2. The zipper device of claim 1 where the first zipper half and the second zipper half each comprise a plurality of teeth such that the teeth of the first zipper half may engage the teeth of the second zipper half.

3. The zipper device of claim 1 where the first zipper half further comprises a zipper pull capable of receiving the second zipper half.

4. The zipper device of claim 1 where the tail portion of the second zipper half is located behind the attached portion of the second zipper half such that the tail portion of the second zipper half and the ramp portion of the first zipper half are located behind the attached portion of the second zipper half and the encircling portion of the first zipper half when the first zipper half and the second zipper half are fully zipped.

5. The zipper device of claim 1 where the first component further comprises a flap adjacent the encircling portion of the first zipper half such that the flap may extend over and conceal the first zipper half and the second zipper half when fully zipped.

6. A method of connecting a first component to a second component, where: the first component is a training or punching bag comprising a vinyl skin and a foam core and is at least partially compressible and comprises: a connecting surface; at least one sidewall extending from the connecting surface; and a first zipper half at least partially attached to the at least one sidewall, where the first zipper half comprises:

an encircling portion that encircles the first component near but not adjacent to the connecting surface; and a ramp portion that extends from the encircling portion toward the connecting surface at less than a 90° angle, where the ramp portion is contiguous to the encircling, portion; and the second component and is a base comprising a vinyl skin and a weighted material and is separate from the first component and comprises: a connecting surface; and a second zipper half at least partially attached to the connecting surface, where the second zipper half comprises:

an attached portion corresponding to the encircling portion of the first zipper half; and a tail portion corresponding to the ramp portion of the first zipper half, where the tail portion is contiguous to the attached portion, the method comprising:

placing the connecting surface of the first component adjacent the connecting surface of the second component; and compressing the first component at least partially by zipping the ramp portion of the first zipper half and the tail portion of the second zipper half together, then progressing to zipping the encircling portion of the first zipper half and the attached portion of the second zipper half together to complete compressing the foam core of the first component at least partially and joining the first component to the second component.

7. The method of claim 6 further comprising folding a flap attached to the first component adjacent the encircling portion of the first zipper half over the first zipper half and the second zipper half.

8. The method of claim 6 where:

the first component is a training or punching bag comprising a vinyl skin and a foam core; and the second component is a base comprising a vinyl skin and weighted material.

* * * * *